US011053664B2

(12) United States Patent
Fukuda et al.

(10) Patent No.: US 11,053,664 B2
(45) Date of Patent: Jul. 6, 2021

(54) HYDRAULIC SYSTEM FOR WORKING MACHINE

(71) Applicant: KUBOTA CORPORATION, Osaka (JP)

(72) Inventors: Yuji Fukuda, Osaka (JP); Yoshimitsu Tanaka, Osaka (JP); Keigo Honda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/364,661

(22) Filed: Mar. 26, 2019

(65) Prior Publication Data

US 2019/0301142 A1 Oct. 3, 2019

(30) Foreign Application Priority Data

Mar. 28, 2018 (JP) ..... JP2018-062415

(51) Int. Cl.
*E02F 9/22* (2006.01)
*F15B 11/16* (2006.01)

(52) U.S. Cl.
CPC ..... *E02F 9/2225* (2013.01); *E02F 9/2267* (2013.01); *E02F 9/2271* (2013.01); *E02F 9/2275* (2013.01); *F15B 11/16* (2013.01); *E02F 9/2285* (2013.01); *E02F 9/2292* (2013.01); *F15B 2211/30505* (2013.01); *F15B 2211/7053* (2013.01); *F15B 2211/71* (2013.01)

(58) Field of Classification Search
CPC ..... F15B 11/16; F15B 2211/88; F15B 21/14; F15B 13/06; F15B 13/07; E02F 9/2225
USPC ..... 60/422; 91/519, 520
See application file for complete search history.

(56) References Cited

U.S. PATENT DOCUMENTS

2017/0175779 A1* 6/2017 Fukuda ..... F15B 11/16
2018/0016770 A1* 1/2018 Honda ..... E02F 9/22

FOREIGN PATENT DOCUMENTS

JP 2010270527 12/2010
JP 2017115928 6/2017
WO 2016/158708 10/2016

* cited by examiner

*Primary Examiner* — Abiy Teka
*Assistant Examiner* — Daniel S Collins
(74) *Attorney, Agent, or Firm* — Greenblum & Bernstein, P.L.C.

(57) ABSTRACT

A hydraulic system includes a hydraulic pump, a first hydraulic actuator, a second hydraulic actuator, a first control valve to control the first hydraulic actuator, and a second control valve to control the second hydraulic actuator, the second control valve being arranged on a downstream side of the first control valve. The hydraulic system includes a first fluid tube in which a return fluid flows toward the second control valve. The first fluid tube couples the first control valve to the second control valve. The hydraulic system includes a second fluid tube in which a supply fluid flows toward to the first hydraulic actuator. The second fluid tube being connected to the first hydraulic actuator. The hydraulic system further a third fluid tube in which the return fluid in the first fluid tube flows toward the second fluid tube.

3 Claims, 3 Drawing Sheets

16
18
83a
83b
20c1
20c3
20(20C)
20c2
44a
44b
44c
29b
93
85
24b
17
17
17c
17d
17a
17b
17e
22b
22a
22
20b1
43c
72
20(20B)
81
73c
36
20b2
35
20b3
86
91
90
34a
34b
81a
81b
43a
43b
42a
42b
42c
24b4
14
14b
14a
14e
14
29a
24c
24b3
24b5
14c
14d
63
61
51
41c
20a1
31
61a
20a3
20a2
21b
21a
21
20(20A)
53c
32
41b
41a
46b
61b
46a
46c
27a
25
24a
P1
27
E
P2
7
15

HYDRAULIC SYSTEM FOR WORKING MACHINE

CROSS-REFERENCE TO RELATED APPLICATIONS

The present application claims priority under 35 U.S.C. § 119 to Japanese Patent Application No. 2018-062415, filed Mar. 28, 2018. The content of this application is incorporated herein by reference in their entirety.

BACKGROUND OF THE INVENTION

Field of the Invention

The present invention relates to a hydraulic system for a working machine.

Description of Related Art

A hydraulic system for a working machine disclosed in Japanese Patent Application Publication No. 2010-270527 is conventionally known. The working machine disclosed in Japanese Patent Application Publication No. 2010-270527 includes a boom, a bucket, a boom cylinder to move the boom, a bucket cylinder to move the bucket, an auxiliary actuator to actuate an auxiliary attachment, a first control valve to control stretching and shortening of the boom cylinder, a second control valve to control stretching and shortening of the bucket cylinder, and a third control valve to actuate the auxiliary actuator.

SUMMARY OF THE INVENTION

A hydraulic system for a working machine includes a hydraulic pump to output an operation fluid, a first hydraulic actuator, a second hydraulic actuator, a first control valve to control the first hydraulic actuator, and a second control valve to control the second hydraulic actuator, the second control valve being arranged on a downstream side of the first control valve. The hydraulic system further includes a first fluid tube in which a return fluid that is the operation fluid returning from the first hydraulic actuator to the first control valve flows toward the second control valve. The first fluid tube couples the first control valve to the second control valve. The hydraulic system further includes a second fluid tube in which a supply fluid that is the operation fluid supplied to the first control valve flows toward to the first hydraulic actuator. The second fluid tube being connected to the first hydraulic actuator. The hydraulic system further includes a third fluid tube in which the return fluid in the first fluid tube flows toward the second fluid tube.

A hydraulic system for a working machine, includes a hydraulic pump to output an operation fluid, a first hydraulic actuator, a second hydraulic actuator, a first control valve to control the first hydraulic actuator, and a second control valve to control the second hydraulic actuator, the second control valve being arranged on a downstream side of the first control valve. In the hydraulic system, the first control valve has a first operational position and a second operational position and is switched between the first operational position and the second operational position, the first operational position allowing a return fluid to be supplied to the second control valve, the return fluid returning from the first hydraulic actuator to the first control valve, and allowing a supply fluid supplied to the first control valve to be supplied to the first hydraulic actuator, the second operational position allowing the return fluid to be supplied to the second control valve and allowing at least a part of the return fluid and the supply fluid to be supplied to the first hydraulic actuator.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
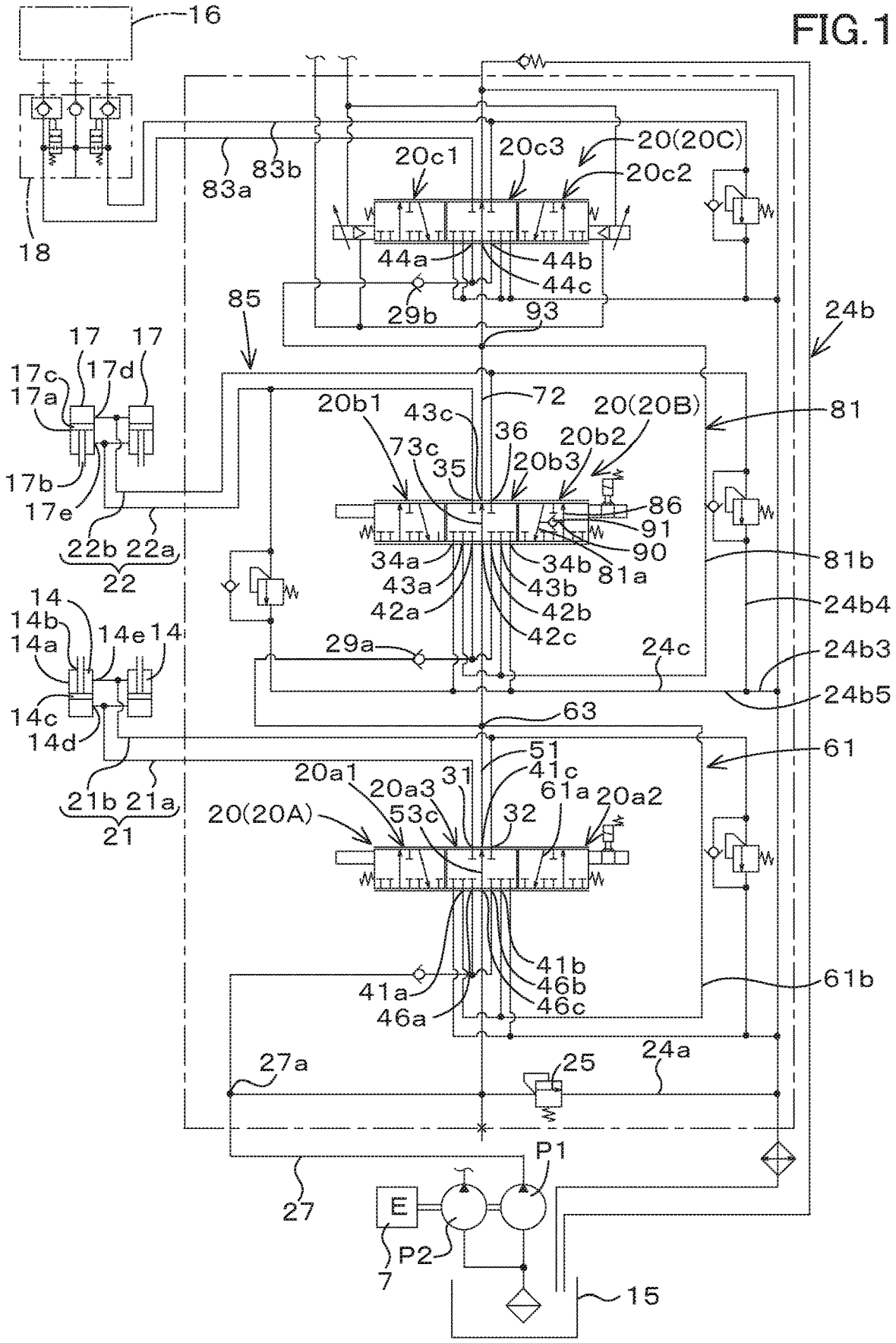
FIG. 1 is a view illustrating a hydraulic system (hydraulic circuit) for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Specifically, embodiments of a hydraulic system for a working machine according to the present invention and of the working machine having the hydraulic system will be described below with reference to the drawings as appropriate.

Figure 3:
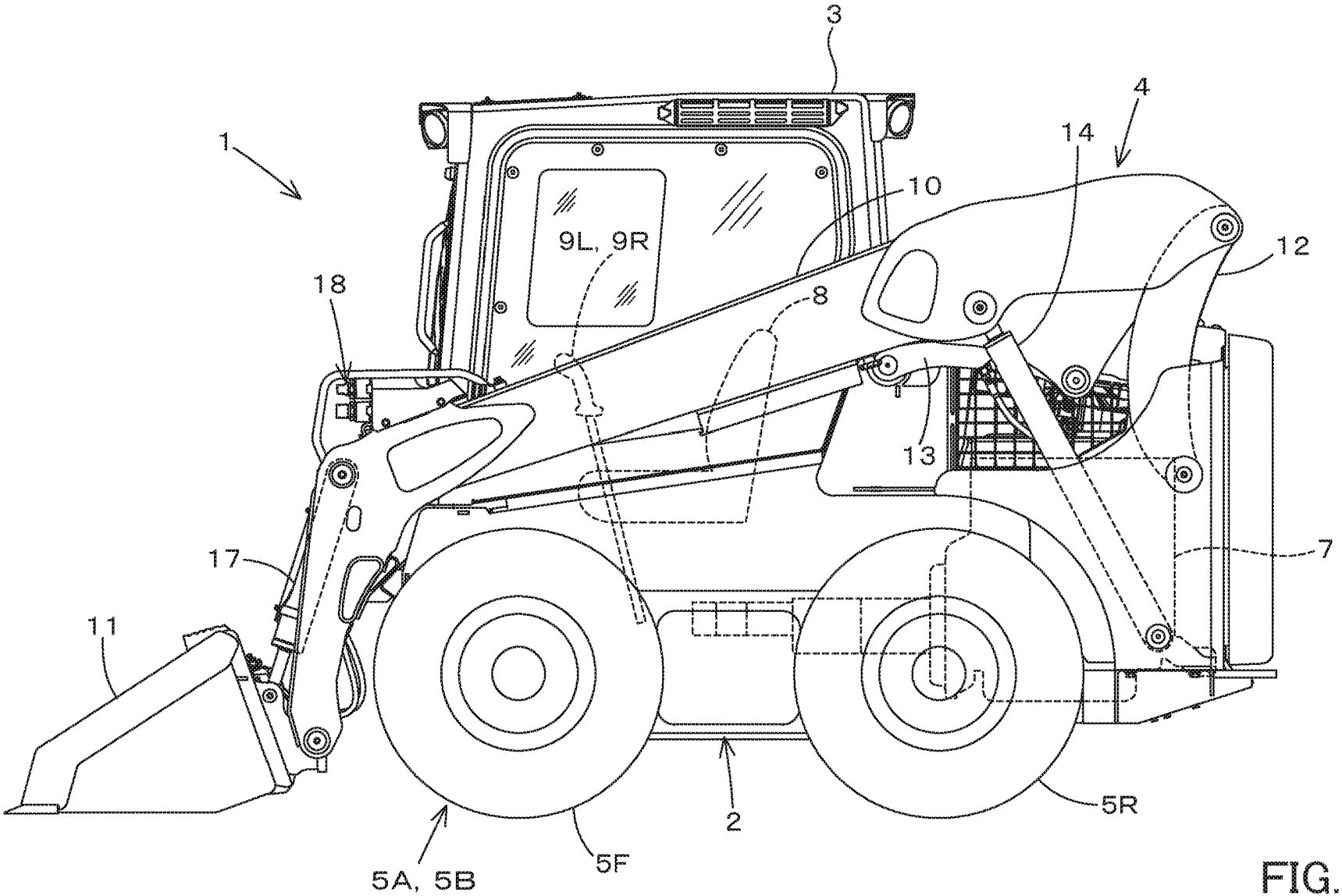
FIG. 3 is a whole view of a skid steer loader exemplified as the working machine according to the embodiment.

Firstly, the working machine will be explained. FIG. 3 shows a side view of the working machine according to the present invention. In FIG. 3, a skid steer loader is shown as an example of the working machine.

However, the working machine according to the present invention is not limited to the skid steer loader. For example, the working machine may be another type of loader working machine such as a compact track loader. In addition, the working machine may be another working machine other than the loader working machine.

The working machine 1 includes a machine body (vehicle body) 2, a cabin 3, a working device 4, and traveling devices 5A and 5B.

A cabin 3 is mounted on the machine body 2. An operator seat 8 is provided at a rear portion of an inside of the cabin 3. In the embodiment of the present invention, the front side of the operator seated on the operator seat 8 of the working machine 1 (the left side in FIG. 3) is referred to as the front. The rear side of the operator (the right side in FIG. 3) is referred to as the rear. The left side of the operator (a front surface side of FIG. 3) is referred to as the left. The right side of the operator (a back surface side of FIG. 3) is referred to as the right.

In addition, a horizontal direction which is a direction orthogonal to the front-to-rear direction will be referred to as a machine width direction. And, a direction from the center portion of the machine body 2 to the right portion or the left portion will be referred to as a machine outward direction.

In other words, the machine outward direction is the machine width direction separating from the machine body 2.

In the explanation, a direction opposite to the machine outward direction is referred to as a machine inward direction. In other words, the machine inward direction is the machine width direction approaching the machine body 2.

The cabin 3 is mounted on the machine body 2. The working device 4 is an apparatus that performs the work and is mounted on the machine body 2. The traveling device 5A is a device for the traveling of the machine body 2, and is provided on the left side of the machine body 2. The traveling device 5B is a device for the traveling of the machine body 2, and is provided on the right side of the machine body 2.

A prime mover 7 is provided at the rear portion of the inside of the machine body 2. The prime mover 7 is an engine (diesel engine). It should be noted that the prime mover 7 is not limited to the engine, and may be an electric motor or the like.

A traveling lever 9L is provided on the left side of the operator seat 8. A traveling lever 9R is provided on the right side of the operator seat 8. The traveling lever 9L provided on the left is for operating the travel device 5A provided on the left, and the traveling lever 9R provided on the right is for operating the travel device 5B provided on the right.

The working device 4 includes a boom 10, a bucket 11, a lift link 12, a control link 13, a boom cylinder 14, and a bucket cylinder 17. The boom 10 is provided on the side of the machine body 2.

The bucket 11 is provided at the tip end (front end) of the boom 10. The lift link 12 and the control link 13 support the base portion (rear portion) of the boom 10. The boom cylinder 14 moves the boom 10 upward and downward.

In particular, the lift link 12, the control link 13 and the boom cylinder 14 are provided on the side of the machine body 2. An upper portion of the lift link 12 is pivotally supported on an upper portion of the base portion of the boom 10. A lower portion of the lift link 12 is pivotally supported on the side portion of the rear portion of the machine body 2.

The control link 13 is arranged in front of the lift link 12. One end of the control link 13 is pivotally supported at a lower portion of a base portion of the boom 10, and the other end is pivotally supported by the machine body 2.

The boom cylinder 14 is a hydraulic cylinder configured to move the boom 10 upward and downward. The upper portion of the boom cylinder 14 is pivotally supported on the front portion of the base portion of the boom 10. The lower portion of the boom cylinder 14 is pivotally supported on the side portion of the rear portion of the machine body 2. When the boom cylinder 14 is stretched and shortened, the lift link 12 and the control link 13 swing the boom 10 upward and downward.

The bucket cylinder 17 is a hydraulic cylinder configured to swing the bucket 11. The bucket cylinder 17 couples between the left portion of the bucket 11 and the boom provided on the left, and couples between the right portion of the bucket 11 and the boom provided on the right.

In addition, in place of the bucket 11, an auxiliary attachment such as a hydraulic crusher, a hydraulic breaker, an angle broom, an auger, a pallet fork, a sweeper, a mower, a snow blower or the like can be attached to the tip end (front portion) of the boom 10.

In the present embodiment, wheel-type traveling devices 5A and 5B each having the front wheels 5F and the rear wheels 5R are adopted as the traveling devices 5A and 5B. Meanwhile, crawler type traveling devices 5A and 5B (including semi-crawler type traveling devices 5A and 5B) may be adopted as the traveling devices 5A and 5B.

Next, a working hydraulic circuit (working hydraulic system) provided in the skid steer loader 1 will be described below.

The working hydraulic system is a system configured to operate the boom 10, the bucket 11, the auxiliary attachment and the like. As shown in FIG. 1, the working hydraulic system includes a plurality of control valves 20 and a working hydraulic pump (first hydraulic pump) P1. In addition, the working hydraulic system is provided with a second hydraulic pump P2 other than the first hydraulic pump P1.

The first hydraulic pump P1 is a pump configured to be operated by the power of the prime mover 7. The first hydraulic pump P1 is constituted of a constant displacement type gear pump. The first hydraulic pump P1 is configured to output the operation fluid stored in a tank (operation fluid tank) 15.

The second hydraulic pump P2 is a pump configured to be operated by the power of the prime mover 7. The second hydraulic pump P2 is constituted of a constant displacement type gear pump. The second hydraulic pump P2 is configured to output the operation fluid stored in the tank (operation fluid tank) 15.

In the hydraulic system, the second hydraulic pump P2 outputs the operation fluid for signals and the operation fluid for controls. The operation fluid for signals and the operation fluid for controls are called a pilot fluid.

The plurality of control valves 20 are valves configured to control various types of hydraulic actuators provided in the working machine 1. The hydraulic actuator is a device configured to be operated by the operation fluid, and is constituted of a hydraulic cylinder, a hydraulic motor, or the like. In the embodiment, the plurality of control valves 20 include a boom control valve 20A, a bucket control valve 20B, and an auxiliary control valve 20C.

The boom control valve 20A is a valve configured to control the hydraulic actuator (boom cylinder) 14 that moves the boom 10. The boom control valve 20A is constituted of a direct-acting spool type three-position switching valve (a direct-acting spool type three-position selector valve).

The boom control valve 20A is configured to be switched to a neutral position 20*a*3, to a first position 20*a*1 other than the neutral position 20*a*3, and to a second position 20*a*2 other than the neutral position 20*a*3 and the first position 20*a*1.

In the boom control valve 20A, the switching between the neutral position 20*a*3, the first position 20*a*1, and the second position 20*a*2 is performed by moving the spool through operation of the operation member.

Meanwhile, the switching of the boom control valve 20A is performed by directly moving the spool through manual operation of the operation member. However, the spool may be moved by the hydraulic operation (hydraulic operation by a pilot valve, and hydraulic operation by a proportional valve).

In addition, the spool may be moved by the electric operation (electric operation by exciting the solenoid). In addition, the spool may be moved by other methods.

The boom control valve 20A and the first hydraulic pump P1 are coupled by an output fluid tube 27. A discharge fluid tube 24*a* connected to the operation fluid tank 15 is connected to a section between the boom control valve 20A and the first hydraulic pump P1.

A relief valve (main relief valve) 25 is provided to an intermediate portion of the discharge fluid tube 24*a*. The operation fluid outputted from the first hydraulic pump P1 passes through the output fluid tube 27 and is supplied to the boom control valve 20A. In addition, the boom control valve 20A and the boom cylinder 14 are coupled to each other by a fluid tube 21.

In particular, the boom cylinder 14 includes a cylindrical body 14*a*, a rod 14*b* movably provided on the cylindrical body 14*a*, and a piston 14*c* provided on the rod 14*b*.

A first port 14*d* for supplying and discharging the operation fluid is provided on the base end portion of the cylindrical body 14*a* (on the side opposite to the rod 14*b* side). A second port 14*e* for supplying and discharging the operation fluid is provided on the tip end of the cylindrical body 14*a* (on the side of the rod 14*b*).

The fluid tube 21 includes a communication fluid tube 21*a* and a communication fluid tube 21*b*. The communication fluid tube 21*a* couples the first port 31 of the boom control valve 20A to the first port 14*d* of the boom cylinder 14. The communication fluid tube 21*b* couples the second port 32 of the boom control valve 20A to the second port 14*e* of the boom cylinder 14.

Thus, when the boom control valve 20A is set to the first position 20*a*1, the operation fluid can be supplied from the communication fluid tube 21*a* to the first port 14*d* of the boom cylinder 14, and further the operation fluid can be discharged from the second port 14*e* of the boom cylinder 14 to the communication fluid tube 21*b*. In this manner, the boom cylinder 14 is stretched, and thereby the boom 10 moves upward.

When the boom control valve 20A is set to the second position 20*a*2, the operation fluid can be supplied from the communication fluid tube 21*b* to the second port 14*e* of the boom cylinder 14, and further the operation fluid can be discharged from the first port 14*d* of the boom cylinder 14 to the communication fluid tube 21*a*. In this manner, the boom cylinder 14 is shortened, and thereby the boom 10 moves downward.

The bucket control valve 20B is a valve configured to control the hydraulic cylinder (bucket cylinder) 17 that controls the movement of the bucket 11. The bucket control valve 20B is a three-position switching valve of pilot-actuated direct-acting spool type (a three-position selector valve of pilot-actuated direct-acting spool type).

The bucket control valve 20B is configured to be switched to a neutral position 20*b*3, to a first position 20*b*1 other than the neutral position 20*b*3, and to a second position 20*b*2 other than the neutral position 20*b*3 and the first position 20*b*1. In the bucket control valve 20B, the switching between the neutral position 20*b*3, the first position 20*b*1, and the second position 20*b*2 is performed by moving the spool through operation of the operation member.

Meanwhile, the switching of the bucket control valve 20B is performed by directly moving the spool through manual operation of the operation member. However, the spool may be moved by the hydraulic operation (hydraulic operation by a pilot valve, and hydraulic operation by a proportional valve). In addition, the spool may be moved by the electric operation (electric operation by exciting the solenoid). In addition, the spool may be moved by other methods.

The bucket control valve 20B and the bucket cylinder 17 are coupled by a fluid tube 22. More specifically, the bucket cylinder 17 includes a cylindrical body 17*a*, a rod 17*b* movably provided on the cylindrical body 17*a*, and a piston 17*c* provided on the rod 17*b*.

A first port 17*d* for supplying and discharging the operation fluid is provided on the base end portion (the side opposite to the rod 17*b* side) of the cylindrical body 17*a*. A second port 17*e* for supplying and discharging the operation fluid is provided on the tip end (the side of the rod 17*b*) of the cylindrical body 17*a*.

The fluid tube 22 includes a communication fluid tube 22*a* and a communication fluid tube 22*b*. The communication fluid tube 22*a* couples the first port 35 of the bucket control valve 20B to the second port 17*e* of the bucket cylinder 17. The communication fluid tube 22*b* couples the second port 36 of the bucket control valve 20B to the first port 17*d* of the bucket cylinder 17.

Thus, when the bucket control valve 20B is set to the first position (first operational position) 20*b*1, the operation fluid can be supplied from the communication fluid tube 22*a* to the second port 17*e* of the bucket cylinder 17, and further the operation fluid can be discharged from the first port 17*d* of the bucket cylinder 17 to the communication fluid tube 22*b*.

In this manner, the bucket cylinder 17 is shortened, and thereby the bucket 11 performs the shoveling operation. When the bucket control valve 20B is set to the second position 20*b*2, the operation fluid can be supplied from the communication fluid tube 22*b* to the first port 17*d* of the bucket cylinder 17, and further the operation fluid can be discharged from the second port 17*e* of the bucket cylinder 17 to the communication fluid tube 22*a*. In this manner, the bucket cylinder 17 is stretched, and thereby the bucket 11 performs the dumping operation.

The auxiliary control valve 20C is valve configured to control the hydraulic actuator (hydraulic cylinder, hydraulic motor, and the like) 16 attached to the auxiliary attachment. The auxiliary control valve 20C is a three-position switching valve of pilot-actuated direct-acting spool type (a three-position selector valve of pilot-actuated direct-acting spool type).

The auxiliary control valve 20C is configured to be switched to a neutral position 20*c*3, to a first position 20*c*1 other than the neutral position 20*c*3, and to a second position 20*c*2 other than the neutral position 20*c*3 and the first position 20*c*1. In the auxiliary control valve 20C, the switching between the neutral position 20*c*3, the first position 20*c*1, and the second position 20*c*2 is performed by moving the spool with use of a pressure of the pilot fluid.

A coupling member 18 is connected to the auxiliary control valve 20C via supplying-discharging fluid tubes 83*a* and 83*b*. A fluid tube connected to the hydraulic actuator 16 of the auxiliary attachment is connected to the coupling member 18.

Thus, when the auxiliary control valve 20C is set to the first position 20*c*1, the operation fluid can be supplied from the supplying-discharging fluid tube 83*a* to the hydraulic actuator 16 of the auxiliary attachment. When the auxiliary control valve 20C is set to the second position 20*c*2, the operation fluid can be supplied from the supplying-discharging fluid tube 83*b* to the hydraulic actuator 16 of the auxiliary attachment.

In this manner, when the operation fluid is supplied to the hydraulic actuator 16 from the supplying-discharging fluid tube 83*a* or the supplying-discharging fluid tube 83*b*, the hydraulic actuator 16 (the auxiliary attachment) can be operated.

The series circuit (series fluid tube) is employed in the hydraulic system. In the series circuit, the operation fluid returned from the hydraulic actuator to the control valve arranged on the upstream side can be supplied to the control valve arranged on the downstream side.

For example, focusing on the bucket control valve 20B and the auxiliary control valve 20C, the bucket control valve 20B is the control valve arranged on the upstream side, and the auxiliary control valve 20C is the control valve arranged on the downstream side.

Hereinafter, the control valve arranged on the upstream side is referred to as a "first control valve", and the control valve arranged on the downstream side is referred to as a "second control valve". A control valve other than the first control valve and the second control valve and provided on the upstream side upper from the second control valve is referred to as a "third control valve".

In addition, the hydraulic actuator corresponding to the first control valve is referred to as a "first hydraulic actuator". The hydraulic actuator corresponding to the second control valve is referred to as a "second hydraulic actuator". The hydraulic actuator corresponding to the third control valve is referred to as a "third hydraulic actuator".

The fluid tube for supplying the return fluid to the second control valve is referred to as a "first fluid tube", the return fluid being the operation fluid returning from the first hydraulic actuator to the first control valve.

In the embodiment, the bucket control valve 20B corresponds to the "first control valve". The auxiliary control valve 20C corresponds to the "second control valve". The boom control valve 20A corresponds to the "third control valve". In addition, the bucket cylinder 17 corresponds to the "first hydraulic actuator". The hydraulic actuator 16 of the auxiliary attachment corresponds to the "second hydraulic actuator". The boom cylinder 14 corresponds to the "third hydraulic actuator".

The first control valve, the second control valve, and the third control valve will be described below in detail.

The third control valve 20A is coupled to the output portion of the first hydraulic pump P1 by an output fluid tube 27. The output fluid tube 27 is branched at the intermediate portion 27*a*.

The fluid tube branched from the output fluid tube 27 is connected to the first input port 46*a* and the second input port 46*b* of the third control valve 20A. In addition, the output fluid tube 27 is connected to the third input port 46*c* of the third control valve 20A.

Thus, the operation fluid outputted from the first hydraulic pump P1 can be supplied to the third control valve 20A through the output fluid tube 27, the first input port 46*a*, the second input port 46*b*, and the third input port 46*c*.

The third control valve 20A and the first control valve 20B are coupled by a central fluid tube 51. The central fluid tube 51 couples the third output port 41*c* of the third control valve 20A and the third input port 42*c* of the first control valve 20B to each other.

When the third control valve 20A is set to the neutral position 20*a*3, the supply fluid, which is the operation fluid supplied from the output fluid tube 27 to the third control valve 20A, is supplied to the central fluid tube 51 through the third control valve 20A by the communication of the central fluid tube 53*c* coupling the third input port 46*c* and the third output port 41*c*.

The third control valve 20A and the first control valve 20B are coupled by the return fluid tube 61 separately from the central fluid tube 51. The return fluid tube 61 is a fluid tube that supplies the return fluid to the first control valve 20B through the third control valve 20A, the return fluid returning from the third hydraulic actuator 14 to the third control valve 20A.

The return fluid tube 61 includes the communication fluid tube 21*a*, the communication fluid tube 61*a*, and the communication fluid tube 61*b*. The communication fluid tube 21*a* is a fluid tube that couples the first port 31 of the third control valve 20A and the first port 14*d* of the third hydraulic actuator 14 to each other, and the return fluid discharged from the first port 14*d* of the third hydraulic actuator 14 flows in the fluid tube.

The communication fluid tube 61*b* is a fluid tube that is provided to the third control valve 20A and is communicated with the communication fluid tube 21*a*. More specifically, when the third control valve 20A is set to the second position 20*a*2, the communication fluid tube 61*b* couples the first port 31 of the third control valve 20A and the first output port 41*a* of the third control valve 20A to each other.

In addition, the communication fluid tube 61*b* couples the first output port 41*a* of the third control valve 20A and the first input port 42*a* of the first control valve 20B to each other, and couples the second output port 41*b* of the third control valve 20A and the second input port 42*b* of the first control valve 20B to each other. An intermediate portion of the communication fluid tube 61*b* is connected to the central fluid tube 51.

In other words, the communication fluid tube 61*b* and the central fluid tube 51 are jointed in the middle with each other. In the communication fluid tube 61*b*, a check valve 29*a* is provided between the first control valve 20B and the confluent portion 63 where the communication fluid tube 61*b* and the central fluid tube 51 are jointed with each other.

The check valve 29*a* allows the operation fluid to flow from the confluent portion 63 to the first control valve 20B, and blocks (prevents) the operation fluid from flowing from the first control valve 20B to the confluent portion 63.

The first control valve 20B and the second control valve 20C are coupled to each other by a central fluid tube 72. The central fluid tube 72 couples the third output port 43*c* of the first control valve 20B to the third input port 44*c* of the second control valve 20C.

Accordingly, when the first control valve 20B is set to the neutral position 20*b*3, the supply fluid, which is the operation fluid supplied to the first control valve 20B, is supplied to the central fluid tube 72 connected to the third output port 43*c* through the central fluid tube 73*c* coupling the third input port 42*c* and the third output port 43*c* to each other.

The first control valve 20B and the second control valve 20C are coupled to each other by a first fluid tube 81 separately from the central fluid tube 72. The first fluid tube 81 is a fluid tube that supplies the return fluid to the second control valve 20C through the first control valve 20B, the return fluid returning from the first hydraulic actuator 17 to the first control valve 20B.

The first fluid tube 81 includes a communication fluid tube (first connection fluid tube) 22*a*, a first inner fluid tube 81*a*, and an outer fluid tube 81*b*. The communication fluid tube 22*a* is a fluid tube that couples the first port 35 of the first control valve 20B and the second port 17*e* of the first hydraulic actuator 17 to each other, and the return fluid discharged from the second port 17*e* flows in the fluid tube.

The first inner fluid tube 81*a* is a fluid tube that is provided in the first control valve 20B and is communicated with the communication fluid tube 22*a*. More specifically, the first inner fluid tube 81*a* is a fluid tube that couples the first port 35 of the first control valve 20B and the first output port 43*a* of the first control valve 20B to each other when the first control valve 20B is set to the second position 20*b*2.

The external fluid tube 81*b* is a fluid tube that is communicated with the first inner fluid tube 81*a* and is connected to the second control valve 20C. The external fluid tube 81*b* couples the first output port 43*a* of the first control valve 20B to the first input port 44*a* of the second control valve 20C, and couples the second output port 43*b* of the first control valve 20B to the second input port 44*b* of the second control valve 20C.

The intermediate portion of the external fluid tube 81*b* is jointed to the central fluid tube 72. A check valve 29*b* is provided between the second control valve 20C and the confluent portion 93 where the external fluid tube 81*b* is jointed to the central fluid tube 72.

The check valve 29*b* allows the operation fluid to flow from the confluent portion 93 to the second control valve 20C, and blocks (prevents) the operation fluid from flowing from the second control valve 20C to the confluent portion 93.

In the hydraulic system for the working machine shown in FIG. 1, the return fluid returning from the first hydraulic actuator 17 to the first control valve 20B can be supplied to the second fluid tube 85 in which the supply fluid flows from the first control valve 20B to the first hydraulic actuator 17.

The second fluid tube 85 includes a communication fluid tube (second connection fluid tube) 22*b* and a second inner fluid tube 86. The communication fluid tube 22*b* is a fluid tube that couples the second port 36 of the first control valve 20B to the first port 17*d* of the first hydraulic actuator 17. In this manner, the communication fluid tube 22*b* is a fluid tube to supply, to the first port 17*d*, the supply fluid flowing to the second port 36.

The second inner fluid tube 86 is a fluid tube that is provided in the first control valve 20B and is communicated with the communication fluid tube 22*b*. In particular, the second inner fluid tube 86 is a fluid tube that couples the second input port 42*b* of the first control valve 20B to the second port 36 of the first control valve 20B to each other when the first control valve 20B is set to the second position 20*b*2.

According to the above configuration, when the first control valve 20B is set to the second position 20*b*2 which is a lateral position, the supply fluid supplied to the second inner fluid tube 86 of the second fluid tube 85 passes through the communication fluid tube 22*b* and enters the first port 17*d* of the first hydraulic actuator 17. When the supply fluid is supplied to the first port 17*d*, the first hydraulic actuator 17 is stretched, for example.

When the first hydraulic actuator 17 is stretched, the return fluid discharged from the second port 17*e* of the first hydraulic actuator 17 passes through the communication fluid tube 22*a* and flows into the first inner fluid tube 81*a*, and the return fluid in the first inner fluid tube 81*a* passes through the external fluid tube 81*b* and flows toward the second control valve 20C. Thus, the return fluid from the first hydraulic actuator 17 can be supplied to the second control valve 20C.

The communication fluid tube 22*b* is connected to the discharge fluid tube 24*b*. The discharge fluid tube 24*b* includes a fluid tube 24*b*4 connected to the communication fluid tube 22*b*, a fluid tube 24*b*5 connected to the first discharge port 34*a* and the second discharge port 34*b* of the first control valve 20B, and the fluid tube 24*b*3 coupling the operation fluid tank 15 to the confluent portion between the fluid tube 24*b*4 and the fluid tube 24*b*5.

Then, the first fluid tube 81 and the second fluid tube 85 are coupled each other by the third fluid tube 90, which may be referred to as the third inner fluid tube 90. The third fluid tube 90 is a fluid tube that supplies the return fluid flowing in the first fluid tube 81 to the second fluid tube 85. In particular, when the first control valve 20B is set to the second position 20*b*2, the third fluid tube 90 communicates the first fluid tube 81 and the second fluid tube 85 with each other, and thereby supplies the return fluid flowing in the first fluid tube 81 to the second fluid tube 85. More specifically, the third fluid tube 90 is a fluid tube that couples the first inner fluid tube 81*a* and the second inner fluid tube 86 to each other.

A check valve 91 is provided in the third fluid tube 90. The check valve 91 allows the return fluid flowing in the first inner fluid tube 81*a* of the first fluid tube 81 to flow toward the second inner fluid tube 86 of the second fluid tube 85, and blocks (prevents) the supply fluid flowing in the second inner fluid tube 86 of the second fluid tube from flowing toward the first inner fluid tube 81*a* of the first fluid tube 81.

According to the above configuration, when the first control valve 20B is set to the second position (second operational position) 20*b*2 which is a lateral position, a part of the return fluid having passed through the first inner fluid tube 81*a* of the first fluid tube 81 passes through the third fluid tube 90, and flows into the second inner fluid tube 86 of the second fluid tube 85.

In other words, the return fluid can be released to the first inner fluid tube 81*a*, and the first control valve 20B can be smoothly operated even when the pressure in the second hydraulic actuator 16 (the side of the second control valve 20C) arranged on the downstream side increases.

Further in other words, at the first position (first operational position) 20*b*1, the first control valve 20B can supply, to the second control valve 20C, the return fluid returned from the first hydraulic actuator 17 to the first control valve 20B, and can supply, to the first hydraulic actuator 17, the supply fluid supplied to the first control valve 20B.

In addition, at the second position (second operational position) 20*b*2, the first control valve 20B can supply the return fluid to the second control valve 20C, and can supply at least a part of the return fluid and the supply fluid to the first hydraulic actuator 17.

For example, some cases will be considered below, for example, a case where the hydraulic actuator 16 falls into an immovable state due to an external force under the state where the hydraulic actuator 16 of the auxiliary attachment is being actuated, a case where the hydraulic actuator 16 constituted of a hydraulic cylinder reaches the termination (the end) and falls into an immovable state under the state where the hydraulic actuator 16 of the auxiliary attachment is being actuated, and a case where the operation fluid is not supplied under the state where the hydraulic actuator 16 of the auxiliary attachment is being actuated.

In other words, a case will be considered below where the return fluid passes through the first fluid tube 81 and no operation fluid is introduced into both of the first input port 44*a* and the second input port 44*b* of the auxiliary control valve 20C.

Under that state, in the case where the third fluid tube 90 is not provided in the first control valve 20B, the return fluid flowing in the first fluid tube 81 has no place to flow into, thereby increasing a pressure generated at the bottom side of the hydraulic actuator 17 communicated with the first fluid tube 81.

When the pressure generated at the bottom side of the first hydraulic actuator 17 is increased, the pressure generated at the rod side of the first hydraulic actuator 17 is also increased. When the cross sectional areas of the bottom side and the rod side are compared with each other inside the first hydraulic actuator 17, the cross sectional area on the bottom side is larger than the cross sectional area on the rod side.

As a result, when the first hydraulic actuator 17 is stretched due to the pressure increasing at the bottom side of the first hydraulic actuator 17, the pressure increasing at the rod side becomes relatively large. For example, in a case where the first hydraulic actuator 17 and the third hydraulic actuator 14 are operated in combination, the movement of the first hydraulic actuator 17 may be delayed when the above-described situation occurs.

On the other hand, when the operation fluid is not introduced into both of the first input port 44*a* and the second input port 44*b* of the auxiliary control valve 20C in the case where the third fluid tube 90 is provided, the return fluid flowing in the first fluid tube 81 is supplied to the second inner fluid tube 86 of the second fluid tube 85 through the first inner fluid tube 81*a*.

In this manner, the return fluid flowing in the first fluid tube 81 can be returned (released) to the first hydraulic actuator 17 via the third fluid tube 90, and thus the first hydraulic actuator 17 can be operated smoothly.

That is, since the return fluid from the rod side of the first hydraulic actuator 17 can be returned to the bottom side of the first hydraulic actuator 17, the speed of stretching of the first hydraulic actuator 17 can be improved.

In particular, when the first hydraulic actuator (bucket cylinder) 17 and the second hydraulic actuator (boom cylinder) 14 are operated in combination, for example, when the boom cylinder 17 is stretched and the bucket cylinder 14 is stretched (when the bucket cylinder 14 is dumped with the boom 14 moved upward), the bucket 11 can be quickly dumped.

Figure 2:
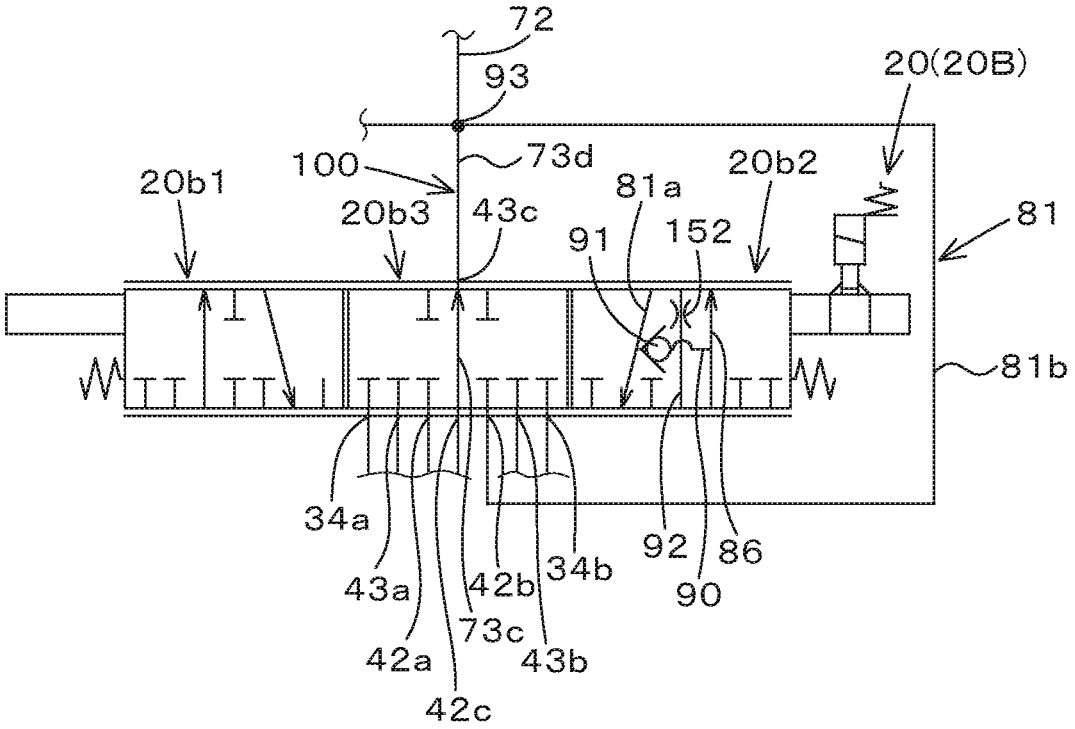
FIG. 2 is a view illustrating a modified example of the hydraulic system for the working machine according to the embodiment.

FIG. 2 shows a modified example of the hydraulic system for the working machine. As shown in FIG. 2, the hydraulic system of the modified example includes a fourth fluid tube 100. The fourth fluid tube 100 is a fluid tube that is communicated with the first fluid tube 81 and is configured to supply, to the first fluid tube 81, the supply fluid supplied to the first control valve 20B.

In particular, the fourth fluid tube 100 includes a communication fluid tube 73*d* and a fourth inner fluid tube 92. The communication fluid tube 73*d* is a part of the central fluid tube 72 and couples the confluent portion 93 and the third output port 43*c* of the first control valve 20B to each other.

The fourth inner fluid tube 92 is a fluid tube that couples the third output port 43*c* of the first control valve 20B and the third input port 42*c* of the first control valve 20B when the first control valve 20B is set to the second position 20*a*2.

According to the modified example shown in FIG. 2, when the first control valve 20B is set to the second position 20*b*2, the supply fluid introduced into the third input port 42*c* of the first control valve 20B can be supplied to the communication fluid tube 73*d* through the fourth inner fluid tube 92.

As the result, the supply fluid having passed through the communication fluid tube 73*d* can be introduced into the external fluid tube 81*b*, and thus the pressure of the operation fluid (the supply fluid and the return fluid) flowing in the external fluid tube 81*b* can be increased. That is, with use of the fourth fluid tube 100, it is possible to increase the back pressure in the first fluid tube 81 in which the return fluid flows.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The first control valve and the second control valve are not limited to the configurations of the above-described embodiments, and may be constituted of any of control valves provided in the working machine.

In the above-described embodiment, the operation fluid is discharged to the operation fluid tank. However, the operation fluid may be discharged to other places. That is, the fluid tube for discharging the operation fluid may be connected to a portion other than the operation fluid tank. For example, the fluid tube for discharging the operation fluid may be connected to the suction portion (a portion from which the operation fluid is sucked) of the hydraulic pump or may be connected to other portions.

In the above-described embodiment, the control valve is constituted of a three-position switching valve (a three-position selector valve). However, the number of switching positions is not limited, and the control valve may be constituted of a two-position selector valve, a four-position selector valve, or another selector valve.

In the above-described embodiment, the hydraulic pump is constituted of a constant displacement pump. However, the hydraulic pump may be constituted of a variable displacement pump whose discharge amount is changed by movement of the swash plate, or may be constituted of another hydraulic pump, for example.

In addition, the first hydraulic actuator, the second hydraulic actuator, the third hydraulic actuator, the first control valve, the second control valve, and the third control valve are not limited to the configurations of the above-described embodiment, and may be those provided in the working machine 1.

What is claimed is:

1. A hydraulic system of a working machine comprising:

a hydraulic pump to output an operation fluid;

a first hydraulic actuator;

a second hydraulic actuator;

a first control valve to control the first hydraulic actuator, the first control valve including a first input port, a second input port, a third input port, a first output port, a second output port, a third output port, a first inner fluid tube, a second inner fluid tube, a third inner fluid tube connecting the first inner fluid tube to the second inner fluid tube, a fourth inner fluid tube, and a discharge port connected to an operation fluid tank;

a second control valve to control the second hydraulic actuator; and an external fluid tube to connect the first output port and the second output port to the second control valve, wherein the first control valve is configured to be switched between a first position and a second position, and the first control valve is configured, at the first position, so that the operation fluid from the hydraulic pump flows into the first hydraulic actuator through the second input port and the second inner fluid tube, a portion of the operation fluid from the first hydraulic actuator flows into the second control valve through the first inner fluid tube, the first output port, and the external fluid tube, a remaining portion of the operation fluid from the first hydraulic actuator flows into the second inner fluid tube through the first inner fluid tube and the third inner fluid tube, the operation fluid from the hydraulic pump flows into the second control valve through the third input port, the fourth inner fluid tube, and the third output port, and the operation fluid from the first hydraulic actuator does not flow into the operation fluid tank through the first inner fluid tube and the discharge port.

2. The hydraulic system according to claim 1, comprising:

a check valve arranged in the third inner fluid tube and configured to allow the operation fluid to flow from the first inner fluid tube into the second inner fluid tube, and prevent the operation fluid to flow from the second inner fluid tube into the first inner fluid tube.

3. The hydraulic system according to claim 1, wherein the fourth inner fluid tube has a throttle arranged therein.

* * * * *